US006797950B2

(12) United States Patent
Schwartz et al.

(10) Patent No.: US 6,797,950 B2
(45) Date of Patent: Sep. 28, 2004

(54) TWO-DIMENSIONAL QUADRUPOLE ION TRAP OPERATED AS A MASS SPECTROMETER

(75) Inventors: Jae C. Schwartz, San Jose, CA (US); Michael W. Senko, Sunnyvale, CA (US)

(73) Assignee: Thermo Finnegan LLC, San Jose, CA (US)

( * ) Notice: Subject to any disclaimer, the term of this patent is extended or adjusted under 35 U.S.C. 154(b) by 0 days.

(21) Appl. No.: 10/357,712

(22) Filed: Feb. 3, 2003

(65) Prior Publication Data

US 2003/0183759 A1 Oct. 2, 2003

Related U.S. Application Data

(60) Provisional application No. 60/354,389, filed on Feb. 4, 2002, and provisional application No. 60/355,436, filed on Feb. 5, 2002.

(51) Int. Cl.[7] ..... H01J 49/42
(52) U.S. Cl. ..... 250/292
(58) Field of Search ..... 250/292

(56) References Cited

U.S. PATENT DOCUMENTS 5,420,425 A * 5/1995 Bier et al. ..... 250/292
5,576,540 A * 11/1996 Jolliffe ..... 250/292
5,750,993 A * 5/1998 Bier ..... 250/292
5,962,851 A 10/1999 Whitehouse et al.
6,069,355 A * 5/2000 Mordehai ..... 250/292
6,331,702 B1 12/2001 Krutchinsky et al.
6,344,646 B1 2/2002 Kato
6,392,225 B1 5/2002 Schwartz et al.
6,545,268 B1 4/2003 Verentchikov et al.

FOREIGN PATENT DOCUMENTS

WO US03/3492 4/2003

* cited by examiner

*Primary Examiner*—Jack I. Berman
(74) *Attorney, Agent, or Firm*—Dorsey & Whitney

(57) ABSTRACT

A three section linear or two-dimensional (2D) quadrupole ion trap as a high performance mass spectrometer is described. Mass analysis is performed by ejecting ions radically out a slot formed in one of the rods using the mass selective instability mode of operation. The slot geometry is optimized to yield high ejection efficiencies. Resolution can be controlled by using appropriate end section potentials to control the axial spread of the ion cloud. Multiple detectors can be used for enhancing sensitivity and for enabling enhanced ion analysis techniques in the ion trap.

40 Claims, 7 Drawing Sheets

TWO-DIMENSIONAL QUADRUPOLE ION TRAP OPERATED AS A MASS SPECTROMETER

RELATED APPLICATIONS

This application claims priority to provisional Applications Ser. No. 60/354,389 filed Feb. 4, 2002 and Ser. No. 60/355,436 filed Feb. 5, 2002.

BRIEF DESCRIPTIONS OF THE INVENTION

This invention relates generally to a two-dimensional quadrupole ion trap operated as a mass spectrometer and more particularly to such a spectrometer providing improved trapping efficiency, increased trapping capacity and excellent mass resolution.

BACKGROUND OF THE INVENTION

Two-dimensional (2D) radio frequency multipole ion traps have been used for several years for the study of spectroscopic and other physical properties of ions. The earliest application of 2D multipole ion traps in mass spectrometry involved the use of the collision cell of a triple quadrupole instrument for studying ion-molecule reactions. More recently, multipole ion traps have been used in mass spectrometers as part of hybrid systems including Fourier transform ion cyclotron resonance (FTICR), time-off-flight (TOF), and standard three-dimensional (3D) ion trap mass spectrometers.

Syka and Fies have described the theoretical advantages of 2D versus 3D quadrupole ion traps for Fourier transform mass spectrometry (U.S. Pat. No. 4,755,670). These advantages include reduced space charge effects due to the increased ion storage volume, and enhanced sensitivity for externally injected ions due to higher trapping efficiencies. Bier and Syka described several forms of linear and circular 2D ion traps with large ion capacity to be used as mass spectrometers (U.S. Pat. No. 5,420,425) using the mass selective instability mode of operation similar to that used in all commercial three-dimensional (3D) quadrupole ion trap instruments.

A linear ion trap includes two pairs of electrodes or rods which contain ions by utilizing an RF quadrupole trapping field in two dimension, while a non-quadrupole DC trapping field is used in the third dimension. Simple plate lenses at the ends of a quadrupole structure can provide the DC trapping field. This approach, however, allows ions which enter the region close to the plate lenses to be exposed to substantial fringe fields due to the ending of the RF quadrupole field. These non-linear fringe fields can cause radial or axial excitation which can result in loss of ions. In addition, the fringe fields can cause shifting of the ions frequency of motion in both the radial and axial dimensions.

An improved electrode structure of a linear quadrupole ion trap 11, which is known from the prior art, is shown in FIG. 1. The quadrupole structure includes two pairs of opposing electrodes or rods, the rods having a hyperbolic profile to substantially match the equipotential contours of the quadrupole RF fields desired within the structure. Each of the rods is cut into a main or central section and front and back sections. The two end sections differ in DC potential from the central section to form a "potential well" in the center to constrain ions axially. An aperture or slot 12 allows trapped ions to be selectively resonantly ejected in a direction orthogonal to the axis in response to AC dipolar or quadrupolar electric fields applied to the rod pair containing the slotted electrode. In this figure, as per convention, the rods pairs are aligned with the x and y axes and are therefore denoted as the X and Y rod pairs.

FIGS. 2*a*–2*c* schematically show the voltages needed to operate this linear ion trap as a mass spectrometer. These voltages include three separate DC voltages, DC1, DC2 and DC3, (typical range of 0 to +/−100 volts) applied to the electrodes of the front, center and back sections to produce the injection and axial trapping fields FIG. 2*a*, two phases of primary RF voltage (typical value of +/−5 KV, with frequencies in the 1 MHz range) applied to opposite rod pairs of the three sections to produce the radial trapping fields FIG. 2*b*, and, two phases of AC resonance excitation voltage (typical range of +/−100V, 5–500 kHz) applied to the pair of electrodes which include the ejection slot(s) for isolation activation and ejection of the ion FIG. 2*c*.

When using a linear ion trap operated in the resonance ejection mass instability mode the mass spectra and resolution are controlled by many of the same processes in the linear ion trap as in a three-dimensional ion trap such as described in U.S. Pat. Nos. 4,540,884 and 4,736,101. However, unlike most three-dimensional ion traps where the trap structure does not require high mechanical tolerances, the performance of a two-dimensional ion trap is more susceptible to mechanical errors. In a three-dimensional ion trap, all of the ions occupy a spherical or ellipsoidal space at the center of the trap typically of a cloud size of 1 mm in diameter. The ions in a two-dimensional ion trap, however, are spread out along a substantial fraction of the entire length of the trap in the axial direction which can be several centimeters or more. Therefore, one could imagine that if the quadrupole rods are not completely parallel, then ions at different axial positions within the trap will experience a slightly different field strength and therefore have slightly different q values. This variation in q value will in turn cause ejection times during mass analysis which are dependent on the ions axial position. The result is increased overall peak widths and degraded resolution. In such a device, if the axial spread of the ion cloud could be reduced then, a smaller variation of q values would be obtained and better resolution would result. This could compromise ion storage volume or space charge capacity for this device, but would make a distorted device into a usable mass spectrometer.

Other parameters also contribute to the overall performance of the linear trap as a mass spectrometer. When using a mass selective instability scan in a linear ion trap, the ions are ejected from the trap in a radial direction. Some researchers have ejected ions between two of the quadrupole rods. However, due to high field gradients loss of ions is substantial. The more efficient way is to eject the ions through a rod by introducing a slot in the rod. For the linear ion trap, the preferred operation is a slot cut along the length of the rod. When a slot (or slots) is cut into one or more of the linear ion trap electrodes to allow ions to be ejected from the device, the electric fields are degraded from the theoretical quadrupole field and therefore the presence of this slot can impact several important performance factors. Consequently, the characteristics of this slot are significant. It should also be noted, that distortion of the electric fields can also be caused by truncation of the hyperbolic surface of the electrodes. Similar to the effects of the slots, these effects also cause field faults and so the overall performance will depend on the combined effects of the slots and the truncation. Normally these truncation effects are small relative to the slots, however the possibility of using their interaction to optimize overall performance exists.

OBJECTS AND SUMMARY OF THE INVENTION

It is a general object of the present invention to provide an improved linear ion trap and mass spectrometer incorporating such an ion trap, which overcomes many of the drawbacks described above and others.

An objective of the present invention is to determine the extent of any distortion in a given rod structure, whether to assure that there is no distortion or to determine what axial cloud size would make the device operational.

It is a further object of the present invention to provide a two-dimensional linear ion trap in which the length, height, shape and number of the ejection slots formed in the electrodes are optimized for operation of the trap in the resonance ejection mass selective instability mode.

It is still another object of the invention to provide a two-dimensional linear ion trap including multiple detectors arranged to receive ejected ions in multiple directions to provide improved sensitivity or the ability to simultaneously scan different mass ranges or the ability to perform mass analysis of both positive and negative ions or combinations thereof.

DESCRIPTION OF FIGURES

The foregoing and other objects of the invention will be more clearly understood from the following description when read in connection with the accompanying drawings of which.

DESCRIPTION OF PREFERRED EMBODIMENT

Figure 1:
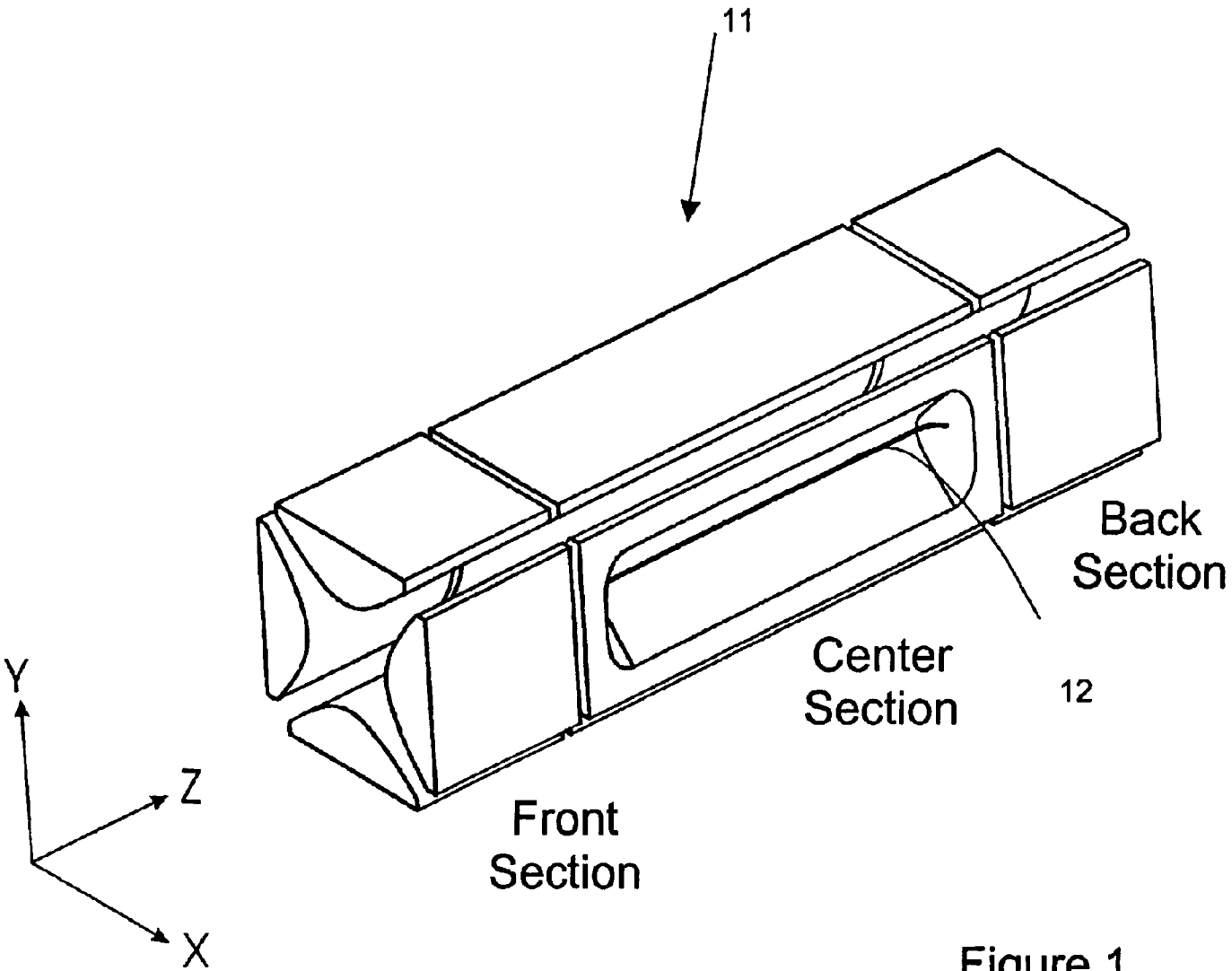
FIG. 1 is a perspective view illustrating the basic design of a two-dimensional linear ion trap.
Figure 2A:
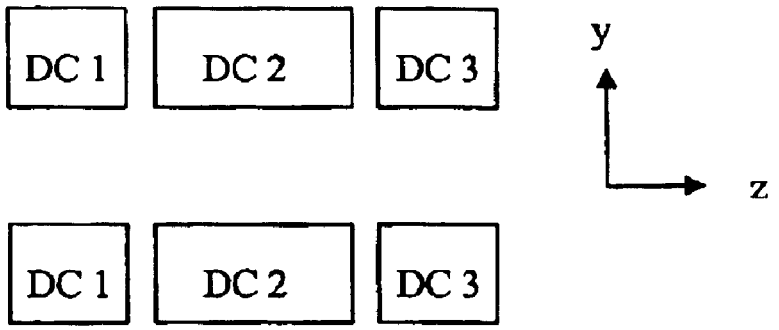
FIGS. 2*a*–2*c* illustrate the DC, RF trapping, and AC excitation voltages necessary for operation of the two-dimensional ion trap.
Figure 2B:
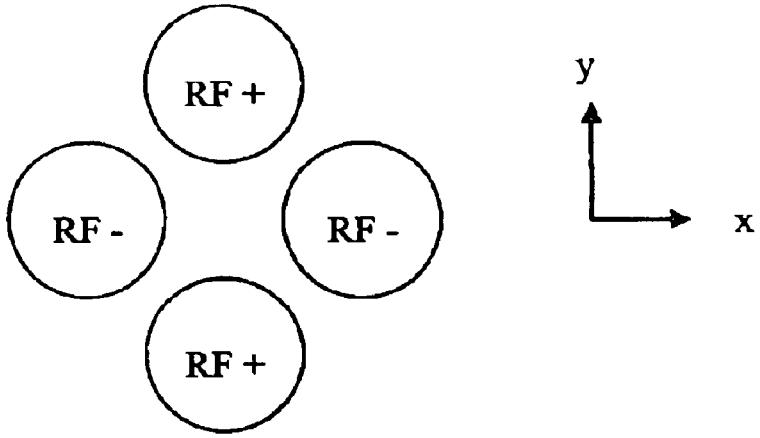
Figure 2C:
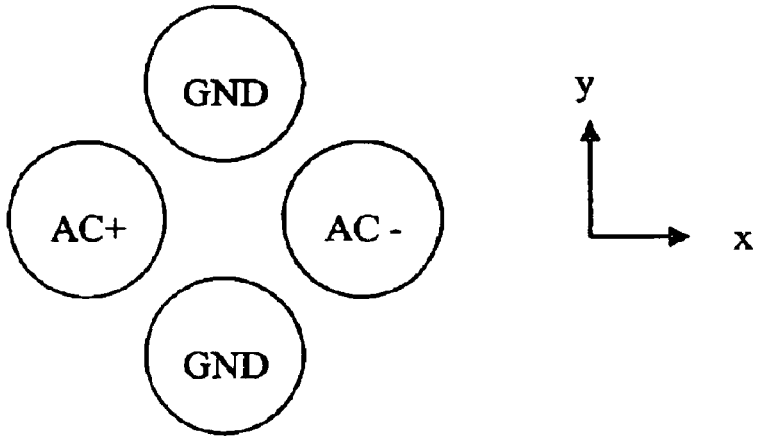
Figure 3:
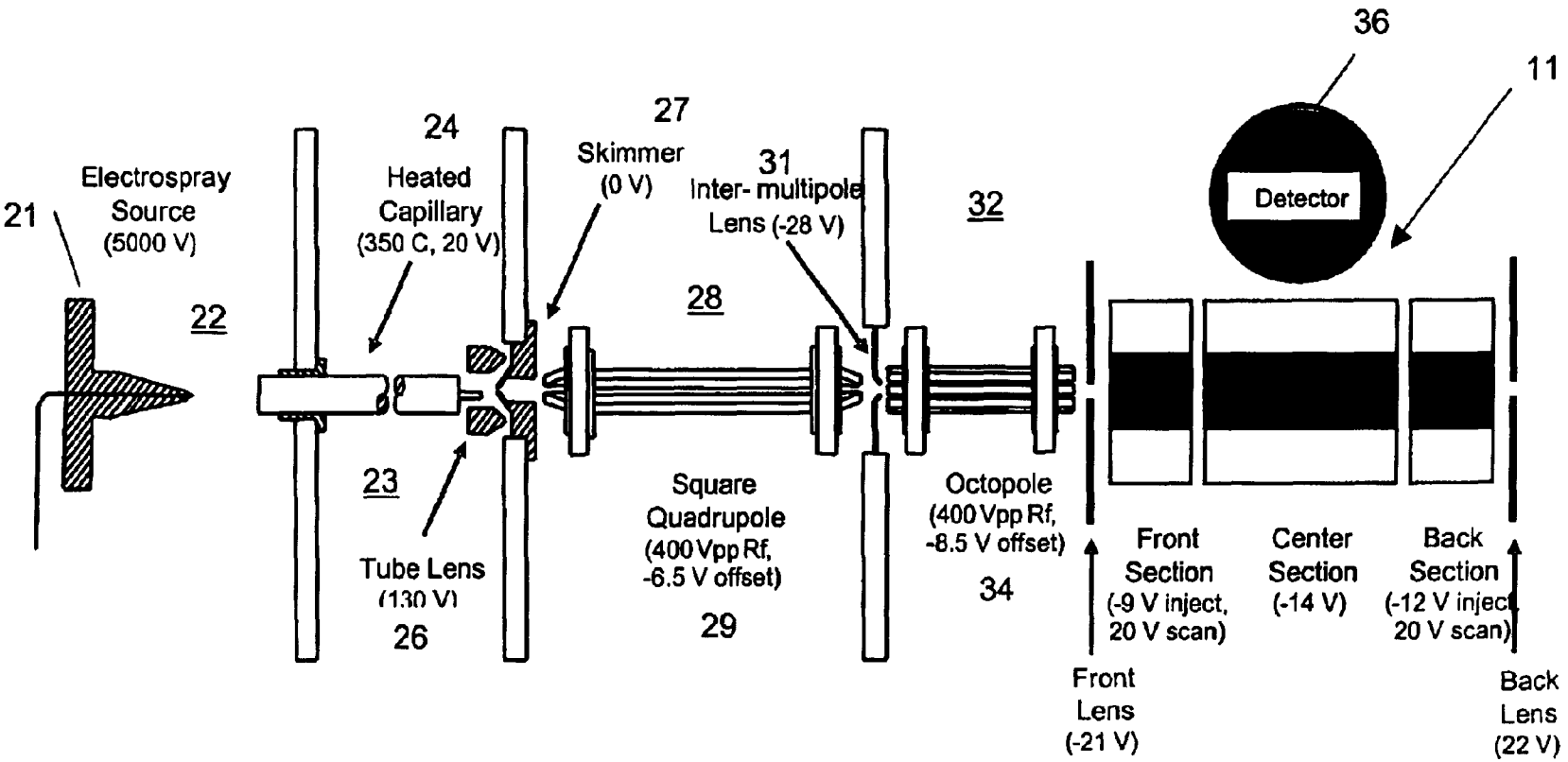
FIG. 3 shows a mass spectrometer instrument configuration along with typical operating voltages.

Referring to FIG. 3 a typical linear ion trap mass spectrometer instrument is schematically illustrated. The instrument includes a suitable ion source such as the electrospray ion source 21 in a chamber 22 at atmospheric pressure. Other types of ion sources which may be accommodated by the instrument comprise atmospheric pressure chemical ionization (APCI), atmospheric pressure photo-ionization (APPI), matrix assisted laser desorption ionization (MALDI), atmospheric pressure-MALDI (AP-MALDI), electron impact ionization (EI), chemical ionization (CI), an electron capture ionization (ECI) source, a fast atom bombardment (FAB) source and a secondary ions (SIMS) source. Ions formed in the chamber 22 are conducted into a second chamber 23, which is at a lower pressure such as 1.0 Torr via a heated capillary 24 and directed by a tube lens 26 into skimmer 27 in a wall of a third chamber 28 that is at still a lower pressure, for example, $1.6\times10^{-3}$ Torr. A heated capillary and tube lens is described in U.S. Pat. No. 5,157,260.

The ions entering the third chamber 28 are guided by quadrupole ion guide 29 and directed through inter-multipole lens 31 to the vacuum chamber 32 at a still lower pressure, for example $2\times10^{-5}$ Torr. This chamber houses the linear ion trap 11. An octapole ion guide 34 directs the ions into the two-dimensional quadrupole (linear) ion trap 11. Typical operating voltages, and temperature are indicated on the drawing. It is to be understood that other ion transfer arrangements can be used to transfer ions from the ion source at atmospheric pressures to the ion trap at the reduced pressure.

During ion injection, ions are axially injected into the linear trap by having the front rod section at for example, minus 9 volts, while the center section rod segments are at minus 14 volts, and the back section rod segments are at minus 12 volts. The ions are radially contained by the RF quadrupole trapping potentials applied to the X and Y rod sets. The ions are then axially trapped by switching the front and back sections to plus 20 volts while leaving the center section at minus 14 volts. In order to obtain a mass spectrum of the contained ions, the amplitude of the RF voltage is ramped linearly to higher amplitudes, while a dipolar AC resonance ejection voltage is applied across the rods in the direction of detection. Ions are ejected through the slot 12 in order of their mass-to-charge ratio (m/z) and are detected by an ion detector 36. Damping gas such Helium (He) or Hydrogen ($H_2$), at pressures near $1\times10^{-3}$ Torr is utilized to help to reduce the kinetic energy of the injected ions and therefore increase the trapping and storage efficiencies of the linear ion trap This collisional cooling continues after the ions are injected and helps to reduce the ion cloud size and energy spread which enhances the resolution and sensitivity during the detection cycle.

Figure 4:
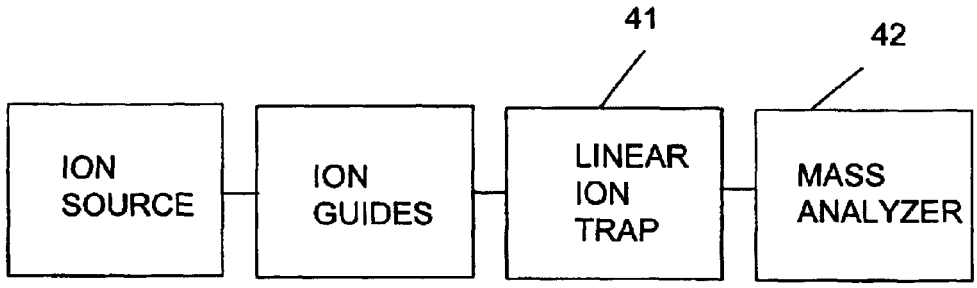
FIG. 4 shows a tandem mass spectrometer incorporating a linear ion trap.

The device described above can be used to process and store ions for later axial ejection into an associate tandem mass analyzer such as a Fourier transform RF quadrupole analyzer, time of flight analyzer or three-dimensional ion trap analyzer. FIG. 4 schematically shows a tandem mass analyzer incorporating a linear f quadrupole mass analyzer 41 as described above, and a tandem mass analyzer 42. The linear quadrupole analyzer 41 can analyze ions by resonance ejection or can eject unwanted ions and store ions for later analysis by the linear quadrupole analyzer 41 or eject them into a tandem mass analyzer 42 for analysis.

Figure 5A:
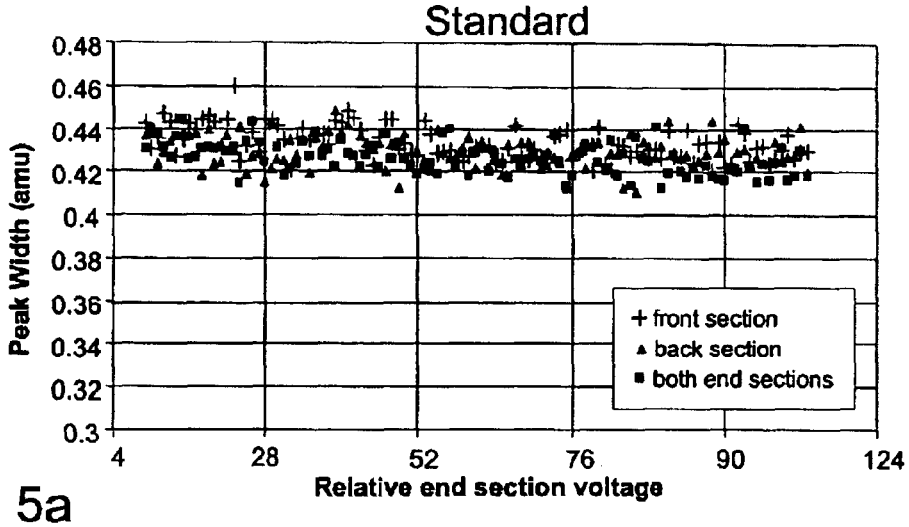
FIG. 5 shows the effect of axial trapping potential on the peak width for (a) a standard trap, (b) a linearly distorted trap by slanting a rod, and (c) a non-linearly distorted trap by twisting a rod.
Figure 5B:
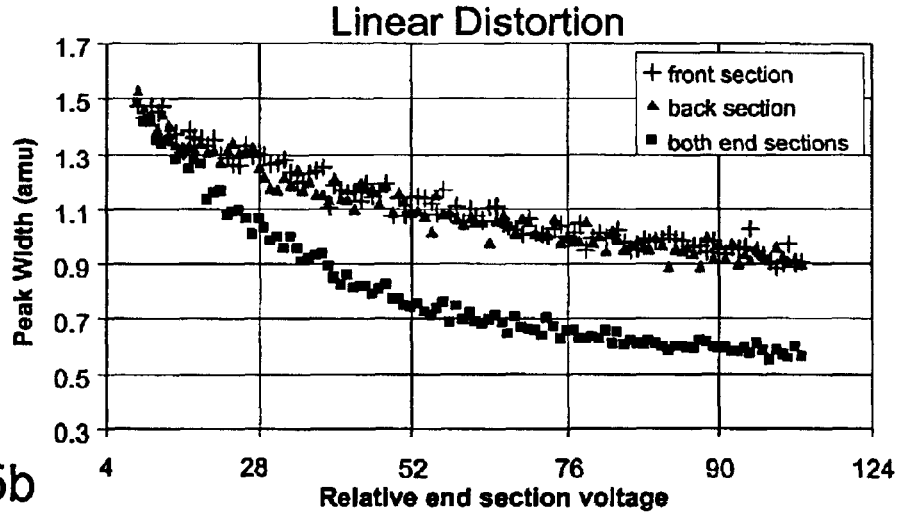

It has been described above that a strong advantage of two-dimensional or linear ion traps over the more established 3D quadrupole ion traps is their ability to hold and analyze significantly more ions. This is due to the fact that the ions can occupy a space which is a large percentage of the length of the device. However, this makes the performance of the two-dimensional ion trap more susceptible to mechanical errors than the 3D ion trap. Since the ions in a two-dimensional ion trap spread out along the length of the trap in the axial direction, any irregularities or deviation from parallelism will subject ions at different axial positions to experience different field strengths and therefore have different q values. This variation will cause ions of the same m/z to have ejection times which will depend on their respective axial positions, which in turn will result in the detected peak width to be increased thereby reducing the overall resolution. In such a device, improved performance would result if the axial spread of the ion cloud could be reduced. Control of the axial dispersion of the ion cloud can be accomplished by changing the amplitude of the DC voltages applied to the end sections which provide the axial trapping field. For example if both end section potentials are increased, a stronger axial field is generated which will squeeze the ion cloud toward the center and will reduce the overall axial dispersion of the ion cloud. Also, not only the axial size, but the axial position of the ion cloud can be controlled by using different voltages applied to the front and back end sections. So, in summary, for a device with poor mechanical tolerances, the mass spectral resolution will vary with axial dispersion and position of the ion cloud due to variations in the strength of the axial trapping field. FIGS. 5*a* and 5*b* demonstrate this effect by measuring the mass spectral peak widths observed for ions of the compound Ultramark 1621 at an m/z 1522. These data compare the effects of changing the front and back end section potentials for both a carefully constructed and unmodified 2-D ion trap and one which has been modified by placing a 0.125 mm shim on one end of one X rod to create a deliberate linear variation of $r_0$ with axial position. (Where $r_0$ is the dimension between the central axis and the apex of the hyperbolic rod, or other shaped rod if an alternative is utilized). Shimming of an X rod provides the worst case distortion, because both the trapping and radial excitation fields are axially inhomogeneous. For the unmodified trap, the peak width is relatively independent of the axial dispersion and position of the ion cloud. For the distorted trap, resolution is highly dependent on the axial dispersion of the ion cloud, as shown by peak widths that are minimized when the axial potentials are maximized. Peak widths of greater than approximately 0.6 amu severely limit the usefulness of the data since isotopic ions can no longer be distinguished from one another. By using high potentials on both the end sections, the peak widths have been decreased (resolution has been increased) to 0.6 amu, which approaches the standard traps performance, making this device produce useful mass spectra.

Figure 5C:
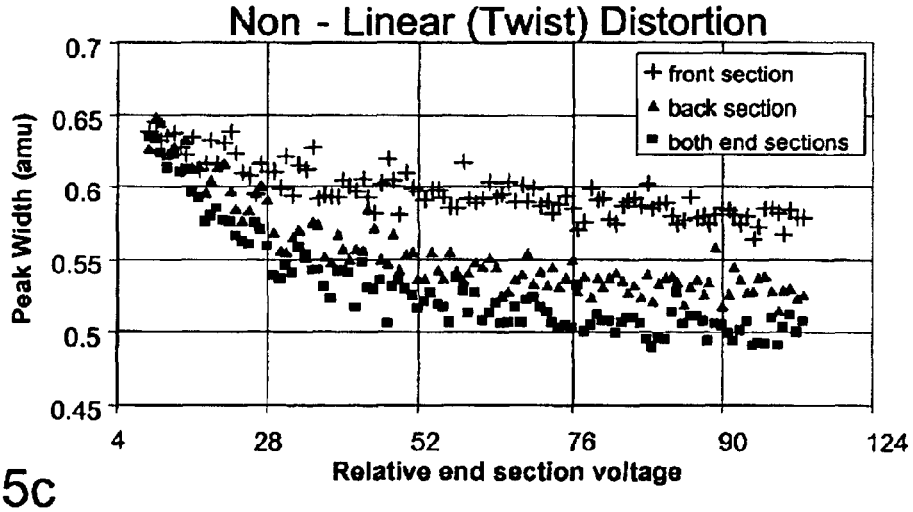

This type of experiment can be used as a general method of evaluating the mechanical tolerances or precision of the trap, and can detect both linear distortions such as non-parallelism, or non-linear distortions such as a bent or twisted rod. A nonlinear distortion such as a twisted rod will show a different variation in resolution when the ion cloud is biased axially from one side of the device versus the other. This effect is demonstrated in FIG. 5*c*, where a deliberate twist was created for one rod by placing a 0.125 mm shim on one corner of one rod, and thus the resolution varies differently when scanning or stepping the potential on the front section versus the back section. Consequently this type of data can be correlated to specific magnitudes and type of structure distortions.

Figure 6:
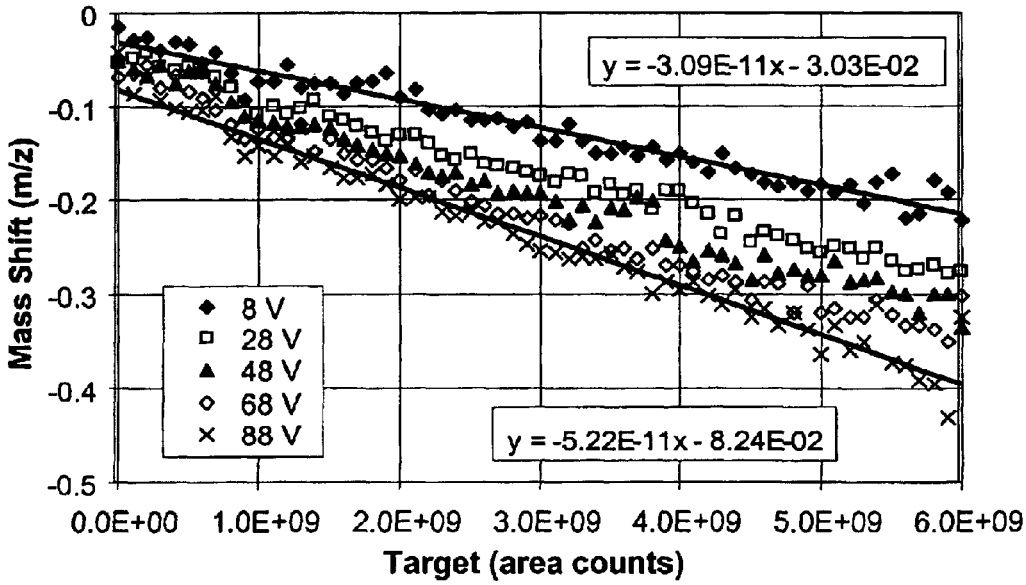
FIG. 6 shows (a) spectral space charge limit comparison between 2D and 3D ion traps. (b) The effect of the axial trapping potential on the spectral space charge limit for the 2D trap.

The trade off for improving the resolution using this method is that due to compression of the cloud size and therefore increased space charge, the capacity of the device is reduced. This effect is shown in FIG. 6. The magnitude of space charge effects can be measured by measuring the amount a mass spectral peak moves as the number of ions in the trap is increased. FIG. 6 plots the amount of mass shift as a function of the total ion current introduced into the trap. It compares this set of data at 5 different settings for the front and back section potentials. The data shows that the rate of change of the mass is approximately 1.7 times higher at the higher end section potentials. This translates into a 1.7 times less ion capacity. Overall, this is a relatively small amount of capacity to give up in order to achieve useful resolution. Nonetheless, in a device of limited mechanical tolerance, this leads to a compromise of either enhanced resolution with high axial trapping potentials and an axially restricted ion cloud, or an enhanced spectral space charge limit with low axial trapping potentials and an axially expanded ion cloud. The appropriate compromise of the set point can be chosen for a particular device or application and can be changed in real time even within a scan for different types of scans such as higher resolution scans or can be switched for higher ion capacity.

An important feature of the linear trap device is the aperture which allows ions to exit the device in order to be detected. Most preferably this aperture or apertures are slots cut axially along some portion of the length of the central section. In general, the presence of a slot introduces field faults distorting the quadrupolar field which, if not considered, can degrade the performance of the mass spectrometer yielding poor resolution and mass accuracy. This distortion, of course, is minimized by using as small a slot as possible, that is of small length and small width. However, the length and width of the slot directly determine how much of the ion cloud will actually be ejected from the trap and reach the detector, and therefore these dimensions are critical in determining sensitivity. Another aspect to be considered is that if the length of the slot is too long, the ions which are ejected through the portions of the slot which are at the ends of the center trapping section are influenced by the non-quadrupolar DC electric fields of the end sections. This causes ions of the same mass to be ejected at slightly different times than ions closer to the center of the trapping section, causing the resolution of the signal that reaches the detector to be degraded.

In addition, the length and width of the slot must be matched to the detector or a substantial fraction of the ions may not be focused onto the detector and will be lost. Hence, the cross-sectional area of the exiting cloud of ions must be designed appropriately for the detector dimensions.

Another consideration is field penetration from the detector, for example a conversion dynode which is held at very high potentials e.g. 15 KV, can also affect performance. This field penetration is minimized by keeping the slot width as small as possible.

In this example, the quadrupole trap structure has hyperbolic rod profiles with an $r_0$ of 4 mm, and the three axial rod sections have 12, 37, and 12 mm lengths respectively. The three sections, each with a discrete DC level, allow containment of the ions in the axial center of the device, avoiding any possible fringe field distortions of the trapping and resonance excitation fields in the center section.

In the preferred embodiment, the slot length is in the range of 80–95% of the overall length of the center section length for optimum performance. The slot in the present example was 30 mm long or substantially 83% of the 37 mm length of the center section. Slot length is considered to be optimum when substantially all the ions can be focused onto the detector, and the ions at the ends of the center trapping section are not substantially influenced by the non-quadrupolar DC electric fields of the end sections.

If the width of the slot is too large, poor resolution and mass accuracy may result, for reasons mentioned above. In the preferred embodiment, the slot width is in the range of 5–10% of the distances between the apex of the quadrupole rod and the axis of the quadrupole, $r_0$, and preferably substantially 6.25%. In our example, with a hyperbolic rod with an $r_0$ of 4 mm, an optimum slot width would be 0.250 mm. Slot widths within this range allow for highly efficient ion ejection (that is, ion ejection of greater than 80%) while keeping performance degradation at a minimum. Larger values lead to a degraded resolution and mass accuracy, while not allowing significantly higher ejection efficiency.

For optimum transmission through the slot the width of the cross-sectional area of the exiting cloud of ions should ideally be able to pass through the slot without being "clipped", that is, without impinging on the peripheral walls of the slot itself. We have found that for a 4.00 mm $r_0$ rod, and a 0.25 mm slot width, a depth (or thickness) of 1.0 mm is the optimum value. A range of 3–5 times the slot width is preferred, with 4 times the slot width being optimum. It is also critical to ejection efficiency that the slot be positioned such that its center is substantially in line with the apex of the hyperbola of the rod itself. Preferably, the center of the slot is in the range of ±0.1 mm (2.5% of $r_0$) from the apex of the hyperbola of the rod. The deviation of the slot width along the length of the rod also plays an important part in selection of this parameter. Preferably, the deviation is in the range of ±0.05 mm (1.25% of $r_0$). The slot may not be of substantially uniform cross section as it extends from one side of the electrode to the other side of the electrode.

The number of slots used in the device can be varied for two reasons. First, to help determine or define the kind of field faults created by the slots themselves. For example and as mentioned above, if only one slot in one rod is used, large amounts of odd-ordered fields such as dipole and hexapole fields are generated. Whereas, if two slots of identical size are used on opposing rods, even order fields such as quadrupole and octopole fields are generated. These different kind of fields are known to cause increased or decreased performance in terms of mass accuracy and resolution. Consequently, the magnitude of each of these different field types can be tailored using the number and characteristics of the slots in this device.

Figure 7:
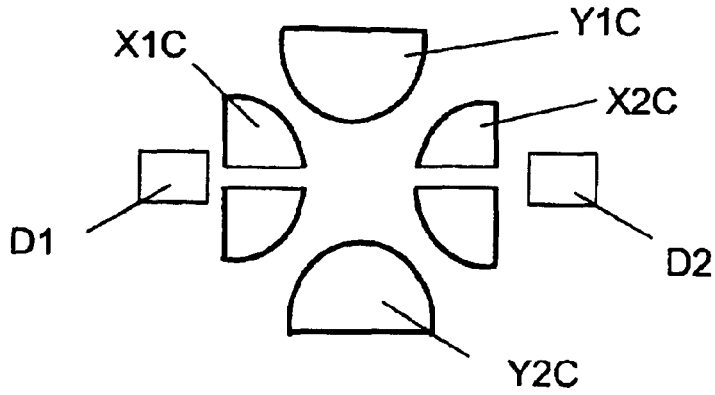
FIG. 7 is a sectional view of the center section of the linear ion trap illustrating the use of two detectors.
Figure 8:
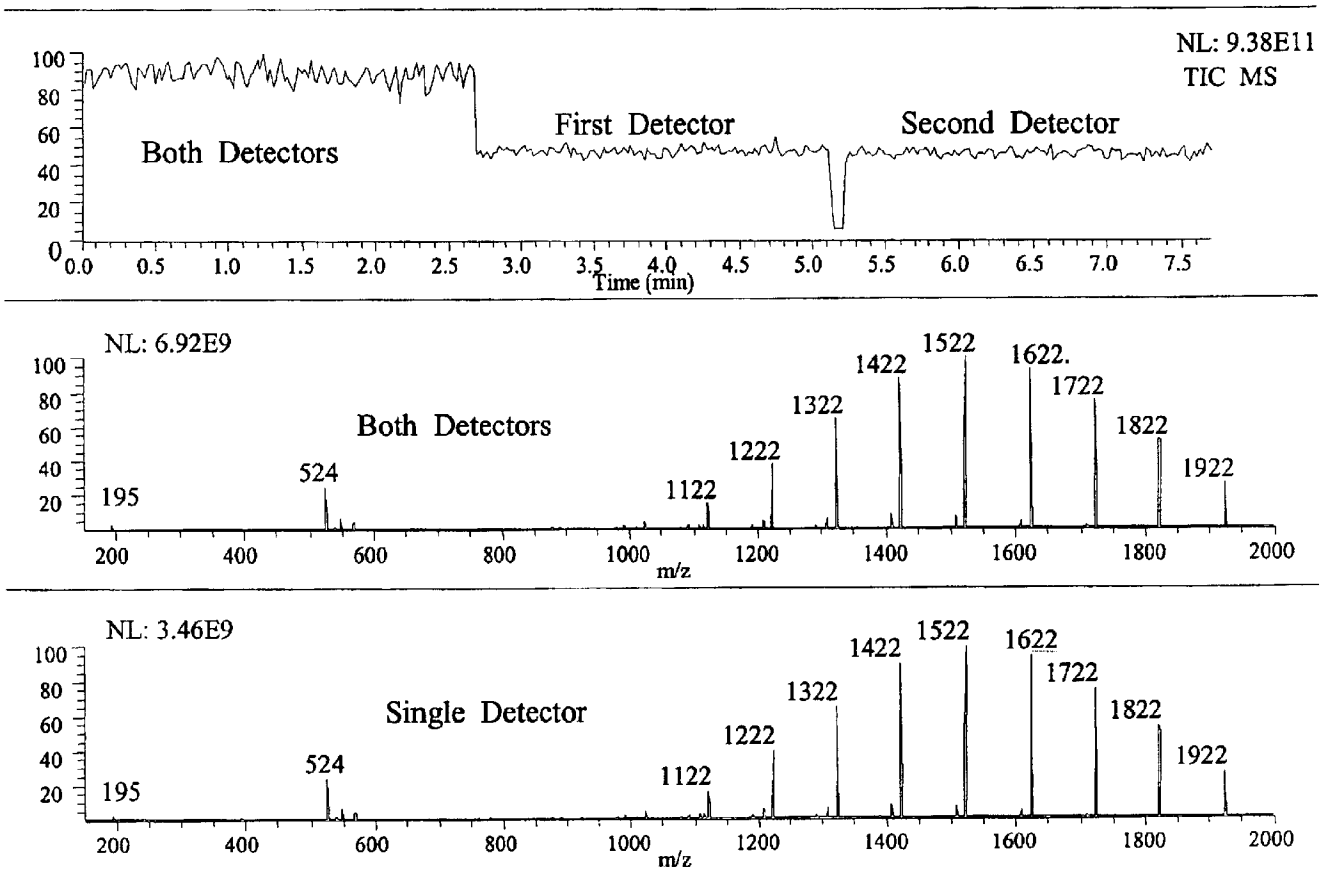
FIG. 8 shows the relative abundance of ions detected utilizing two detectors.

The second reason to vary the number of slots is to allow for more than one detector to be used. This is a significant advantage of a linear or 2D ion trap over a 3D ion trap. Since in a three-dimensional ion trap, ions are injected along the same axis that the ions are detected, detection was only easily performed by detecting ions ejected in one direction. It is well know that when using resonance ejection mass selective instability scans, ions try to exit the trap in both directions in which the resonance signal is applied. Consequently in a 3D ion trap, 50% of the detectable ions are lost since they are ejected toward the ion source side. In the linear ion trap, putting slots on both sections which have the resonance signals applied (central X rods) allows substantially all of the ejected ions to be detected using two detectors. This is schematically shown in FIG. 7 where the opposing X rods X1C, X2C are slotted and detectors D1, D2 are associated with each. This essentially doubles the sensitivity of analysis of a single detector system. FIG. 8 shows that precisely a factor of two in signal is gained when using two detectors.

Figure 9:
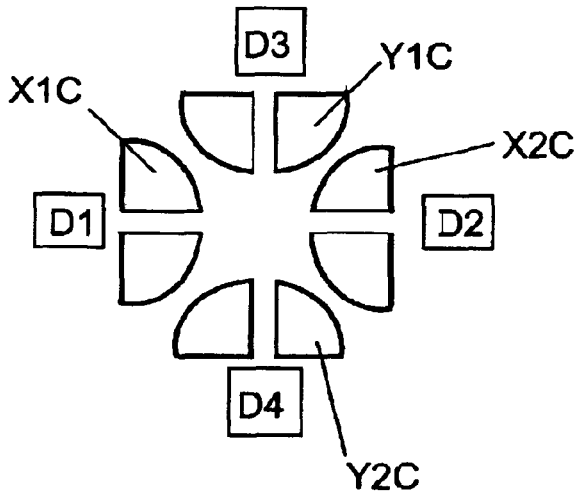
FIG. 9 is a sectional view of the center section of the linear ion trap illustrating the use of four detectors.

The possibility exists of detecting ions in up to four orthogonal directions requiring up to four slots and four detectors and also to utilize the X and Y ejection directions for different purposes. Resonance ejection in the ion trap is shown as being in one radial direction, the X direction. However, it is also possible to provide slots in the Y rods and to provide detectors therewith and excite the Y rods with an AC resonance voltage. This resonance ejection could be configured such that a different mass range from the mass range scanned out in the X direction is simultaneously performed and would require one or two separate detectors. This would require separate AC signals to be applied differentially to the X and to the Y rod pairs respectively. Typically, resonance ejection is performed at a fairly high q value which corresponds to frequencies nearly ½ the frequency of the main rf frequency. Ions having a m/z at some low value of interest are placed at this q value. Then the rf amplitude is scanned linearly up to some maximum voltage which ejects ions up to some maximum m/z by moving their q value to the ejection q. Now, by applying a second resonance ejection signal on say the Y rods at a fairly low q value, a higher mass range will be ejected at this q value simultaneously as ions are ejected at the higher q value when the rf amplitude is ramped. For example the X direction could scan MIZ 200–2000 while the Y direction would scan M/Z 2000–20,000. This general scheme is depicted in FIG. 9. The foregoing use of 4 detectors is illustrated in FIG. 9 wherein all rods are shown with slots 12 and detectors D1, D2, D3 and D4 associated therewith.

Figure 10:
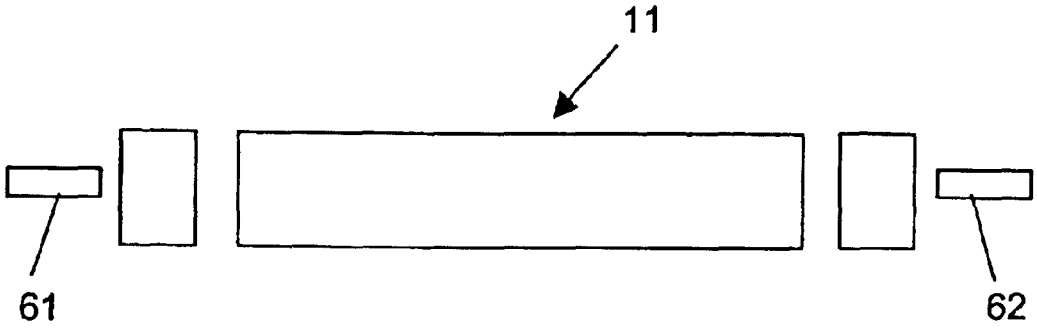
FIG. 10 is a schematic view of a linear ion trap with ion injection into the trap from both ends of the trap.

Another possibility for using the X and Y detectors is to detect positive and negative ions simultaneously. The detectors can only be set up to detect one polarity of ion at a given time, so let the Y be set for negative ions and X for positive. Ions of both polarities can be formed in the trap or can be injected using two different ion sources which are readily coupled to the trap 11, one at each axial end as shown in FIG. 10 or by accumulating the two polarity ions at different times. Then, when doing the resonance ejection mass selective instability scan, by adding a fairly small quadrupole DC voltage either on X or Y rod sets, or in some combination, positive and negative ions will be ejected in orthogonal directions.

Utilization of the available axial direction can also be implemented. A fifth detector could be added here to simply be able to measure total ion current when the ion cloud is pulsed out this direction by lowering the back section potential. The available axial direction could be used for a second source of ions or electrons which would enhance the applicability of the ion trap system for different types of analytes. As mentioned above, positive and negative ion sources 61 and 62 can be used to inject ions into the ion trap from opposite directions. The use of this arrangement would include fundamental ion recombination studies, a method of ion activation based upon recombination of negative ions or electrons with positive ions, or a method of reducing space charge effects using oppositely charged particles.

Alternatively, the available axial direction could be used to couple the linear trap to another mass analyzer such as Fourier transform RF quadruple analyzers, time of flight analyzers and three-dimensional ion traps or other type of mass analyzer in a hybrid configuration. Hybrid mass spectrometers are well known to combine the strengths of different type of mass analyzers into a single instrument. The option also exists to couple several linear ion traps together in the axial direction.

The foregoing descriptions of specific embodiments of the present invention are presented for the purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A linear ion trap for trapping and subsequently ejecting ions comprising:

at least four spaced substantially parallel elongated electrodes, said electrodes each including at least a front, a center and a back segment, said center segment of said electrodes defining therebetween an elongated trapping volume, said elongated trapping volume having a center axis, at least one of said center electrode segments, including an elongated slot, wherein the length of the slot is 80–95% of the overall length of the center [electrode] segment electrode.

2. An ion trap as in claim 1 wherein the slot comprises at least two apertures.

3. An ion trap as in claim 1 wherein the slot is of substantially uniform cross section as it extends from one end of the electrode to the other end of the electrode.

4. An ion trap as in claim 2 wherein the slot is not of substantially uniform cross section as it extends from one side of the electrode to the other side of the electrode.

5. An ion trap in accordance with claim 1 wherein the slot is designed such that greater than 70% of the ejected trapped ions in the direction of the detector reach the detector.

6. An ion trap according to claim 1 wherein the length of the slot is 80–85% of the overall length of the center [section] segment electrode.

7. An ion trap according to claim 6 wherein the length of the slot is 83% of the overall length of the center [section] segment electrode.

8. An ion trap according to claim 1 wherein the width of the slot is 5–10% of $r_0$.

9. An ion trap according to claim 8 wherein the width of the slot is 6.25% of $r_0$.

10. An ion trap according to claim 1 wherein the electrodes are hyperbolic in shape and wherein the center of the slot is substantially in line with the apex of the hyperbola.

11. An ion trap as in claim 1 wherein the slot width varies no more than 1.25% of $r_0$ along its length.

12. A linear ion trap for trapping and subsequently ejecting ions comprising:

at least four spaced substantially parallel elongated electrodes, said electrodes each including at least a front, a center and a back segment, said center segment of said electrodes defining therebetween an elongated trapping volume, said elongated trapping volume having a center axis, at least one of said electrodes including an elongated slot;

RF means to supply RF trapping voltages to said electrodes to thereby form trapping fields for trapping ions along the center axis;

DC means to provide a DC field which traps ions within said trapping volume;

AC means exciting a portion of the trapped ions and ejecting at least some of the ions from said trapping volume through said elongated slot; and wherein the width of the slot is 6.25% of $r_0$.

13. A linear ion trap for trapping and subsequently ejecting ions comprising:

at least four spaced substantially parallel elongated electrodes, said electrodes each including at least a front, a center and a back segment, said center segment of said electrodes defining therebetween an elongated trapping volume, said elongated trapping volume having a center axis, at least two of said electrodes including an elongated slot; and detector means associated with each of said slots for detecting ions which are ejected therefrom.

14. A linear ion trap as in claim 13 in which opposite electrodes are slotted.

15. A linear ion trap as in claim 13 in which all electrodes are slotted and detector means are associated with each slot to detect ions which are ejected through the associated slot.

16. A linear ion trap in accordance with claims 13 wherein at least one of the detection means detects ions of a first nature, and at least one other of the detection means detects ions of a second nature.

17. A linear ion trap as in claim 16 wherein the first nature is negative ions and the second nature is positive ions.

18. A linear ion trap as in claim 16 wherein the first nature is a first mass range and the second nature is a mass range different to that of the first mass range.

19. A linear ion trap as in claim 13 including first means disposed at one end of the trapping chamber and second means disposed at the other end of the ion trap for introducing ions into said trapping volume.

20. An ion trap as in claim 13 wherein the outputs from the two detection means are coupled to improve the efficiency of the mass spectrometer operation.

21. A mass spectrometer comprising:

an ion source disposed in a first substantially atmospheric pressure chamber;

a second pressure chamber having a pressure less than that of the first chamber;

a third pressure chamber having a pressure less than that of the second chamber, and comprising an ion guide structure;

a linear ion trap disposed in a fourth pressure chamber, said linear ion trap comprising:

at least four spaced substantially elongated electrodes, said electrodes each including a front, a center and a back segment, said center segment of said electrodes defining an elongated trapping volume;

at least one of said center electrode segments including an aperture having a length of 80–95% of the electrode length;

means for applying DC trapping voltages to said segments to confine ions as an ion cloud within said elongated trapping volume;

means for supplying RF trapping voltages to said electrodes;

means for applying resonance excitation voltages to at least one pair of opposite electrodes of which at least one electrode includes an aperture; and at least one detection means for detecting ions ejected through said aperture.

22. A mass spectrometer according to claim 21 wherein the ion source is selected from the group consisting of APCI (Atmospheric Pressure Chemical Ionization), APPI (Atmospheric Pressure Photo-Ionization), APPCI (Atmospheric Pressure Photo-Chemical Ionization), MALDI (Matrix Assisted Laser Desorption Ionization), AP-MALDI (Atmospheric MALDI), and ESI (Electrospray Ionization).

23. A mass spectrometer according to claim 21 wherein the second pressure chamber comprises a heated capillary.

24. A mass spectrometer according to claim 21 wherein the third pressure chamber comprises a square quadrupole.

25. A mass spectrometer according to claim 21, further comprising a transition section between the third and fourth pressure chambers.

26. A mass spectrometer according to claim 25 wherein the transition section comprises an ion guide.

27. A mass spectrometer according to claim 26 wherein the ion guide comprises an octopole.

28. A mass spectrometer according to claim 21 wherein the detection means comprises a conversion dynode.

29. A mass spectrometer according to claim 24, further comprising a second mass spectrometer.

30. A mass spectrometer comprising:

a linear ion trap for trapping and subsequently ejecting ions, said linear ion trap including at least four spaced substantially parallel elongated electrodes each including at least a front, a center and a back segment, said center segment of said electrodes defining an elongated trapping volume having a center axis and at least one of said center electrode segments including an elongated slot having length which is 80–95% of the length of the electrode segment;

means for introducing ions into said trapping volume to form an ion cloud; and means for applying trapping and ejection voltages to selected electrode segments to trap and eject ion from said trap through said elongated slot.

31. A mass spectrometer as in claim 30 in which one of the trapping voltages comprises different DC voltages applied to the front, center and back electrode segments.

32. A mass spectrometer as in claim 31 in which the DC voltages applied to the front and back electrode segments controls the extent of the ion cloud along the center axis.

33. A mass spectrometer as in claim 30 in which the width of the slot is 6.25% of $r_0$.

34. A mass spectrometer as in claim 33 in which the slot width varies no more than 1.25% of $r_0$ along its length.

35. A method of controlling the axial dispersion of an ion cloud trapped in an ion trap of the type which includes at least four spaced substantially parallel elongated electrodes defining therebetween a trapping volume with at least one of said electrodes including an elongated slot and including means at the end of said electrodes for providing a DC trapping field to trap ions in the volume between the electrodes comprising the step of controlling the amplitude of the DC trapping voltage to provide an axial trapping field to thereby control the axial dispersion of the trapped ion cloud to control the resolution of the ion trap.

36. A method for determining the mechanical precision of a linear ion trap of the type which comprises at least four spaced substantially parallel elongated electrodes, said electrodes each including a front, a center and a back segment, said center segment of said electrodes defining an elongated trapping volume, comprising the steps of applying [RF and] DC trapping voltages to the electrode segments to trap ions, scanning or stepping the DC trapping voltage[s] potentials applied to the front and back segments and ejecting ions, detecting the ejected ions, [and] measuring their peak widths (the resolution) [in response to] as the DC trapping potential is scanned or stepped [DC trapping voltage], and comparing the peak widths with those of a standard linear ion trap having the same dimensions for the same DC trapping voltage.

37. A method according to claim 36 wherein the resolution [can be] is correlated to the mechanical precision.

38. A method according to claim 37 wherein the resolution [can be] is correlated to a type of structural distortion.

39. A mass spectrometer comprising:

an ion source disposed in a first substantially atmospheric pressure chamber;

a second pressure chamber having a pressure less than that of the first chamber;

a third pressure chamber having a pressure less than that of the second chamber, and comprising an ion guide structure;

a linear ion trap disposed in a fourth pressure chamber, said linear ion trap comprising:

at least four spaced substantially elongated electrodes, said electrodes defining an elongated trapping volume;

at least two of said electrodes include slots;

means for supplying RF trapping voltages to said electrodes;

means for applying resonance excitation voltages to at least one pair of opposite electrodes of which at least one electrode includes a slot through which to eject ions; and a detector associated with each slotted electrode.

40. A mass spectrometer comprising:

a linear ion trap for trapping and subsequently ejecting ions, said linear ion trap including at least four spaced substantially parallel elongated electrodes each including at least a front, a center and a back segment, said center segment of said electrodes defining between an elongated trapping volume having a center axis and at least two of said center electrode segments including an elongated slot having length which is 80–95% of the length of the electrode segment and a width that is 6.25% of $r_0$;

means for introducing ions into said trapping volume to form an ion cloud; and means for applying trapping and ejection voltages to selected electrode segments to trap and eject ion from said trap through said elongated slot.

* * * * *